US007231140B2

(12) United States Patent
Dolton, III

(10) Patent No.: US 7,231,140 B2
(45) Date of Patent: Jun. 12, 2007

(54) SYSTEM FOR REMOVING SNOW AND ICE FROM A SURFACE

(76) Inventor: Edward Gerard Dolton, III, 189 Manorside Dr., Brick, NJ (US) 08724

( * ) Notice: Subject to any disclaimer, the term of this patent is extended or adjusted under 35 U.S.C. 154(b) by 0 days.

(21) Appl. No.: 11/176,541

(22) Filed: Jul. 7, 2005

(65) Prior Publication Data

US 2006/0083493 A1 Apr. 20, 2006

Related U.S. Application Data

(60) Provisional application No. 60/619,316, filed on Oct. 15, 2004.

(51) Int. Cl.
*A61H 33/08* (2006.01)

(52) U.S. Cl. ..... 392/379; 392/360; 219/213

(58) Field of Classification Search ..... 392/379–385, 392/360, 363–369; 219/213; 37/227, 230, 37/197; 454/233, 228; 165/108
See application file for complete search history.

(56) References Cited

U.S. PATENT DOCUMENTS

| | | | | |
|---|---|---|---|---|
| 2,476,543 | A * | 7/1949 | Geissler et al. | 415/58.4 |
| 2,779,856 | A * | 1/1957 | Fahner | 392/382 |
| 2,820,450 | A | 1/1958 | Zimmerman | |
| 3,174,477 | A | 3/1965 | Wilson | |
| 3,311,104 | A | 3/1967 | Wollner et al. | |
| 3,411,174 | A * | 11/1968 | Jordan | 15/310 |
| 3,524,044 | A * | 8/1970 | Liardi | 219/203 |
| 3,603,507 | A * | 9/1971 | Devlin | 239/14.1 |
| 3,964,183 | A | 6/1976 | Mouat | |
| 4,033,055 | A | 7/1977 | Lazarecky | |
| 4,918,844 | A | 4/1990 | Marsh | |
| 5,140,762 | A | 8/1992 | Monson | |
| 5,146,695 | A * | 9/1992 | Yang | 34/90 |
| 5,189,756 | A | 3/1993 | Sprunger | |
| 5,282,264 | A * | 1/1994 | Reeves et al. | 392/382 |
| 5,867,926 | A * | 2/1999 | Schmitt | 37/227 |
| 5,948,299 | A | 9/1999 | Scalia | |
| 2002/0069560 | A1 | 6/2002 | Smith | |

FOREIGN PATENT DOCUMENTS

| | | | |
|---|---|---|---|
| DE | 2613066 | * | 9/1977 |
| FR | 2376028 | * | 9/1978 |
| GB | 987946 | * | 3/1965 |

* cited by examiner

*Primary Examiner*—Thor S. Campbell
(74) *Attorney, Agent, or Firm*—Kaliko & Yeager; Scott H. Kaliko

(57) ABSTRACT

A system for removing snow and ice from a surface that includes a fan and a heating element contained within a hollow cavity open at one end, and a hollow duct positioned above the hollow cavity. The hollow duct is open at both ends; one end is positioned directly above the open end of the hollow cavity, while the other end leads back into the hollow cavity through a hole on the other side of the heating element contained therein. The fan blows air past the heating element and out the open end of the hollow cavity. The heated air melts any snow or ice with which it comes into contact. At least some of the heated air that does not contact any snow or ice is drawn into and through the hollow duct, and back into the hollow cavity where it may be reused.

9 Claims, 2 Drawing Sheets

SYSTEM FOR REMOVING SNOW AND ICE FROM A SURFACE

RELATED APPLICATION

This application claims the benefit, pursuant to 35 U.S.C. §119(e)(1), of U.S. Provisional Application Ser. No. 60/619,316, filed Oct. 15, 2004.

BACKGROUND OF THE INVENTION

This invention relates to a system for removing accumulated snow and ice that is adapted for use on surfaces such as sidewalks, driveways, roadways, buildings, motor vehicles, and elsewhere. More particularly, this invention relates to a portable system, which uses and recaptures heated air, for initiating the removal of snow and ice from said surfaces.

Snow and ice removal from sidewalks, walkways, driveways, and patios is traditionally carried out by using a shovel and/or a hoe. The problems associated with the use of such traditional devices are many. First, for example, a significant amount of labor is involved with the removal of snow and ice. Second, a shovel may not remove all of the snow from a surface, especially from a textured surface such as cobblestone or brick. Third, on such textured surfaces, it is difficult to shovel at all due to the shovel engaging the corners of the cobblestone, brick, or like surface. Finally, using a hoe or similar device with too much force may damage expensive outdoor surfaces.

To overcome some of the deficiencies associated with a shovel, the snow blower was invented. This device has been around for decades. However, snow blowers also have several deficiencies. For example, snow blowers may use electric power and often are limited by the range of the extension cord and/or the short term or low watt power supply of a portable battery that provides power to the unit. Snow blowers may also use gasoline powered engines that are deficient in that they require the storage of gasoline, may emit harmful and foul odors, and are extremely noisy. Moreover, given the large size of snow blowers, they are often unsuitable for use in tight alley ways and near buildings. They also are unable to remove solid ice from surfaces.

To overcome the deficiencies of the snow blower, several inventions for melting snow and ice have been proposed. These include U.S. Pat. No. 5,948,299, to Scalia, for a Portable Snow Melting Device; United States Publication No. US/2002/0069560 A1, by Smith, for a Snow Melting Device; and U.S. Pat. No. 5,140,762, to Monson, for an Apparatus for Melting Snow and Ice. These known devices may melt snow and ice; however, they are inefficient in their consumption of power in converting electrical/chemical energy into heat energy, and many of them are not versatile in their ability to be used in small spaces or on uneven or non-ground level surfaces.

It therefore would be desirable to provide a system for removing snow and ice from a surface that overcomes the deficiencies of the aforementioned prior art.

SUMMARY OF THE INVENTION

It is therefore an object of the present invention to provide a system for removing snow and ice from a surface that overcomes the deficiencies of the prior art.

It is also an object of the present invention to provide a system for removing snow and ice from a surface that uses energy efficiently and recycles the unused heat it produces.

It is another object of the present invention to provide a system for removing snow and ice from a surface that is portable and may be used in narrow or tight areas.

It is yet another object of the present invention to provide a system for removing snow and ice from a surface that is versatile enough to be used on rough surfaces, surfaces made up of loose stones or gravel, surfaces that are not on ground level, or substantially vertical surfaces.

In accordance with the present invention, a system for removing snow and ice from a surface is provided. This system, according to a preferred embodiment of the present invention, may include a housing unit, one or more blower means, a heating element, a heat reclamation means, and a power source means. The power source means may be incorporated within or located externally from the housing unit. The heat reclamation means may be any suitable device for reclaiming at least some of the heated air that is expelled from the blower housing unit for subsequent reuse.

The above and other objects, features, and advantages of the present invention will become apparent upon consideration of the following detailed description, taken in conjunction with the accompanying drawings in which like reference characters refer to like parts throughout.

DETAILED DESCRIPTION OF THE PREFERRED EMBODIMENTS

Figure 1:
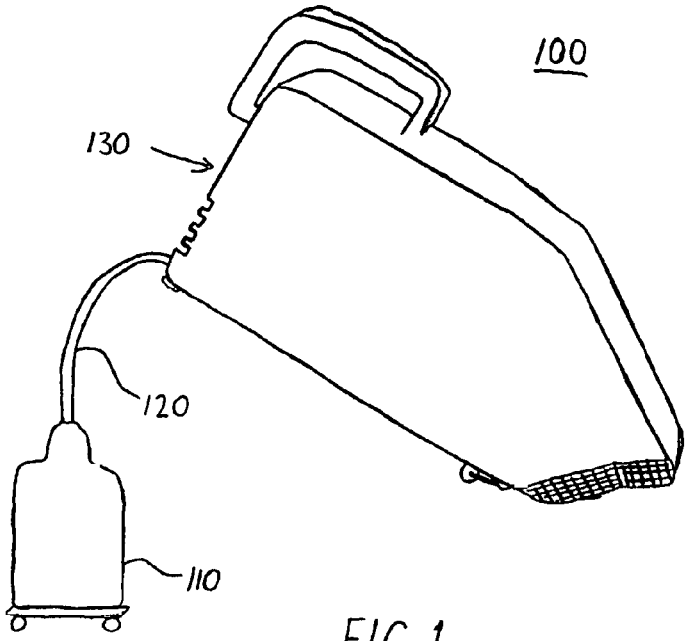
FIG. 1 shows a generalized perspective view of a first preferred embodiment of a system for removing snow and ice according to the present invention.

The present invention is designed to provide heated air in order to remove snow and/or ice from a surface such as a driveway or walkway, including one having a rough surface or one which is made up of loose stones or gravel, a building, or a motor vehicle, and to recapture and recycle expelled but unused heated air. FIG. 1 shows a generalized perspective view of a first preferred embodiment of a snow and ice removal system 100 according to the present invention.

As shown in FIG. 1, system 100 may include a power source means 110, a flexible hose or cord 120, one end of which is attached to power source means 110, and a blower device 130, to which the other end of flexible hose or cord 120 is attached. As shown in FIG. 1, power source means 110 may be a tank of propane or another fuel, in which case hose 120 allows such fuel to flow from power source 110 to blower device 130. Power source means 110 may instead be electrical power provided by a wall socket, in which case cord 120 allows the flow of electricity to blower device 130. Alternatively, system 100 may employ an internal power source, such as a rechargeable battery, as discussed below in connection with a second preferred embodiment of the present invention.

Figure 3:
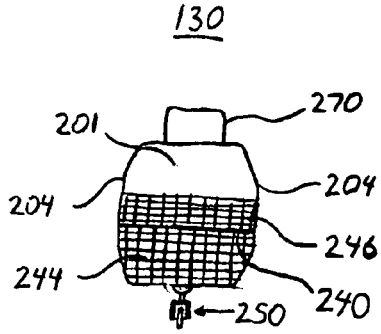
FIG. 3 shows a front view of the first preferred embodiment of the system for removing snow and ice according to the present invention.
Figure 2:
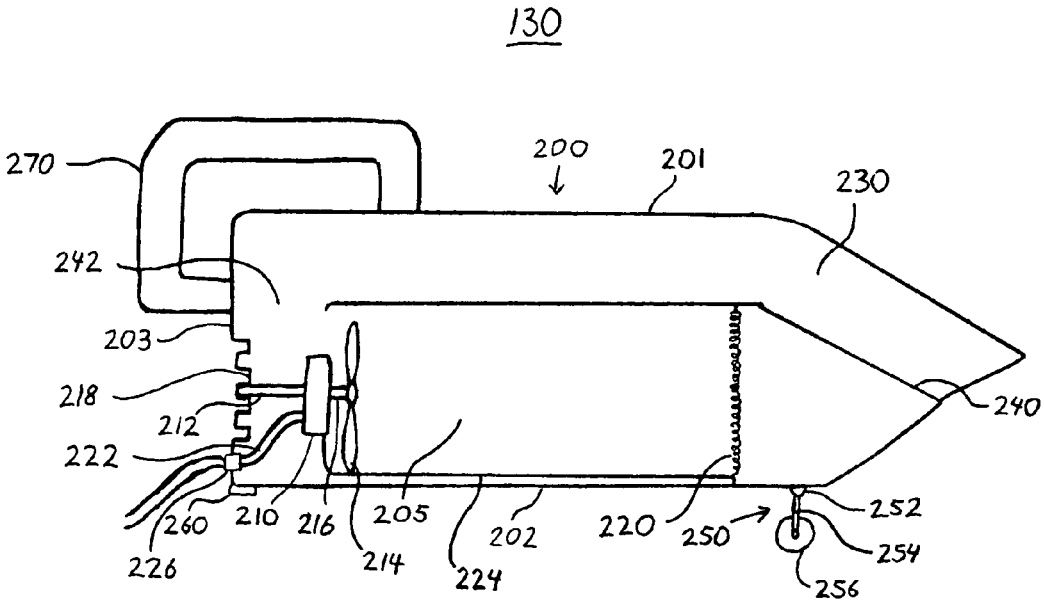
FIG. 2 shows a sectional side view of the first preferred embodiment of the system for removing snow and ice according to the present invention.
Figure 4:
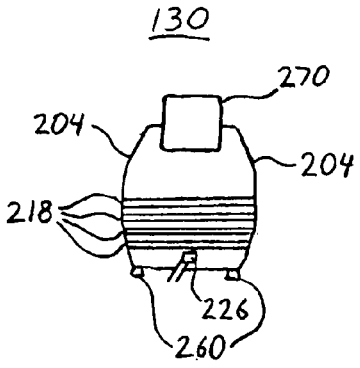
FIG. 4 shows a rear view of the first preferred embodiment of the system for removing snow and ice according to the present invention.

FIG. 2 shows a detailed sectional side view of the first preferred embodiment of the present invention. As shown in FIG. 2, blower device 130 may include a blower device housing unit 200. Housing unit 200 may be defined by a top wall 201, a bottom wall 202, a rear wall 203, two side walls 204, and a substantially hollow cavity. The walls of housing unit 200 may be made of plastic or another durable material, and they may be substantially flat, as the top wall 201, bottom wall 202, and rear wall 203 are shown in FIG. 2, or they may be curved or angled, as the two side walls 204 are shown in FIG. 3 and FIG. 4. Additionally, top wall 201 may be curved or bent downward, as shown in FIG. 2, so that it nears, but does not reach, bottom wall 202 the farther away it gets from rear wall 203.

Housing unit 200 may contain a heat production section 205 defined by a lower portion of the hollow cavity of housing unit 200, a duct-like heat reclamation section 230 defined by an upper portion of the hollow cavity of housing unit 200, and a dividing wall 240 disposed between heat production section 205 and heat reclamation section 230. Dividing wall 240 may extend from one side wall 204 to the other side wall 204, and from a front end of housing unit 200 toward, but not reaching, rear wall 203. The space between rear wall 203 and dividing wall 240 may define an air transfer opening 242, which allows recycled heated air to pass from heat reclamation section 230 to heat production section 205, as more fully discussed below. Alternatively, heat production section 205 and heat reclamation section 230 may not share a wall, but instead may each have its own complete and distinct shell, with space in between the two sections, and may only meet at air transfer opening 242.

A motor 210 may be disposed within heat production section 205, and may be mounted to housing unit 200 by a motor mounting means 212. Motor mounting means 212 may be one or more rigid posts made of metal or another rigid material. Motor mounting means 212 may be mounted to rear wall 203, as shown in FIG. 2, or may alternatively be mounted to top wall 201, bottom wall 202, and/or side walls 204. A fan 214 may be rotatably attached to motor 210, disposed towards the front end of housing unit 200 relative to motor 210, by a fan mounting means 216. Fan mounting means 216 may be made of metal, plastic, or another sturdy material. A plurality of vents 218 may be defined by spaces in rear wall 203, as shown in FIG. 4. As shown in FIG. 2, vents 218 may extend into one or both side walls 204. Vents 218 may be disposed toward a lower portion of rear wall 203 so that they allow outside air to pass through rear wall 203 into the heat production section 205 of housing unit 200.

A heating element 220 may also be disposed within heat production section 205, toward the front end of housing unit 200 relative to fan 214, and may be mounted to bottom wall 202, dividing wall 240, and/or side walls 204. Heating element 220 may consist of one or more heating coils or any other electrically powered heat source capable of fitting within heat production section 205 between fan 214 and the front end of housing unit 200.

An internal hose or cord 222 may be disposed within heat production section 205 so that one end of internal hose or cord 222 is attached to motor 210 and the other end of internal hose or cord 222 is attached to a port 226. Port 226 may be made of rubber or a like material and may be snugly fit within a hole in rear wall 203, as shown in FIG. 2, or in a hole in bottom wall 202 or in either side wall 204. Flexible hose or cord 120 may be attached to blower device 130 at port 226 so that, if power source means 110 is a tank of propane or another fuel, hose 120 and internal hose 222 may be connected at port 226 and sealed together to allow fuel to pass from power source means 110 to motor 210 without leakage. If power source means 110 is electrical power provided by a wall socket, cord 120 and internal cord 222 may be connected at port 226 to allow the flow of electricity from power source means 110 to motor 210.

An electrical wire 224 also may be disposed within heat production section 205. One end of electrical wire 224 may be connected to motor 210, and the other end of electrical wire 224 may be connected to heating element 220, to allow the flow of electricity from motor 210 to heating element 220. Alternatively, if power source means 110 is electrical power provided by a wall socket, electrical wire 224 may be directly connected at one end to cord 120 at port 226, with the other end still connected to heating element 220.

As shown in FIG. 3, a lower screen 244 may be disposed at an open front end of heat production section 205, substantially covering such front end from bottom wall 202 to dividing wall 240 and from one side wall 204 to the other. An upper screen 246 may be disposed at an open front end of heat reclamation section 230, substantially covering such front end from top wall 201 to dividing wall 240 and from one side wall 204 to the other. Lower screen 244 and upper screen 246 may be made of metal, plastic, or another durable material. Lower screen 244 and upper screen 246 may allow air to pass through the front end of housing unit 200 while preventing accidental access to its interior by users.

A retractable wheel apparatus 250 may be disposed on an exterior side of bottom wall 202, toward the front end of housing unit 200. Retractable wheel apparatus 250 may consist of a wheel mount 252, a wheel attachment means 254, and a wheel 256. Wheel mount 252 may be permanently mounted to housing unit 200. Wheel attachment means 254 may be rotatably attached to wheel mount 252 so that wheel attachment means 254 may rotate from a lowered position where wheel attachment means 254 is substantially perpendicular to bottom wall 202, as shown in FIG. 2, to a raised position where wheel attachment means 254 is pointed away from the front end of housing 200. This may be accomplished using a ball-and-socket joint disposed within wheel mount 252, or by any other means suitable to moveably attach wheel attachment means 254 to wheel mount 252. Wheel mount 252 and wheel attachment means 254 may be made of any durable material. Wheel 256 may be rotatably attached to an opposite end of wheel attachment means 254 so that wheel 256 may rotate freely with respect to wheel attachment means 254. Wheel 256 may be made of rubber or another like material. Alternatively, a wheel may be rotatably attached to a wheel attachment means which is non-moveably mounted to the exterior of bottom wall 202, toward the front end of housing unit 200, or at another position on the exterior of bottom wall 202.

One or more feet 260 may be disposed on bottom wall 202, at or near the edge where bottom wall 202 meets rear wall 203. For example, as shown in FIGS. 2 and 4, two feet 260 may be mounted on bottom wall 202, substantially at the corners where rear wall 203 meets each side wall 204, respectively. Feet 260 may be made of rubber or another like material. Feet 260, along with wheel 256, may allow blower device 130 to be rested on a surface without scratching or otherwise damaging either the surface or the outside of housing unit 200.

One or more handles 270 may be disposed on the outside of housing unit 200. Handles 270 may be attached to top wall 201, rear wall 203, or, as shown in FIG. 2, one end of handle 270 may be attached to top wall 201, handle 270 may wrap around the edge between top wall 201 and rear wall 203, and a second end of handle 270 may be attached to rear wall 203. Handles 270 may alternatively be disposed on one or both side walls 204.

In operation, fan 214, powered by motor 210, generates high velocity wind as it blows air through heat production section 205 and toward the front end of housing unit 200. Said air is heated to a temperature sufficient to melt snow and ice from a surface as it is blown past heating element 220. The heated air is blown through the open front end of heat production section 205 and, when blower device 130 is aimed at it, makes contact with snow and/or ice on a surface and acts to melt said snow and/or ice. At least some of the heated air that does not reach the snow and/or ice rises toward the open front end of heat reclamation section 230. To maximize the amount of unused heated air that reaches the open front end of heat reclamation section 230, it may be concavely curved or angled with respect to the open front end of heat production section 205, as shown in FIG. 2, or at least substantially parallel with the same. The unused heated air that reaches the open front end of heat reclamation section 230 is drawn into heat reclamation section 230 and through air transfer opening 242 by fan 214. Along with fresh air drawn through vents 218, the unused heated air is again blown by fan 214 past heating element 220 and through the open front end of heat production section 205. By thus recycling unused heated air, the temperature of the air that is blown out of heat production section 205 may continue to increase, causing snow and/or ice to melt more quickly, and thereby conserving the power needed from power source means 110 as well as the energy exerted by the user of system 100.

Figure 6:
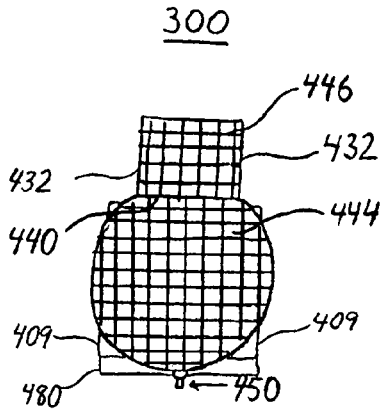
FIG. 6 shows a front view of the second preferred embodiment of the system for removing snow and ice according to the present invention.
Figure 5:
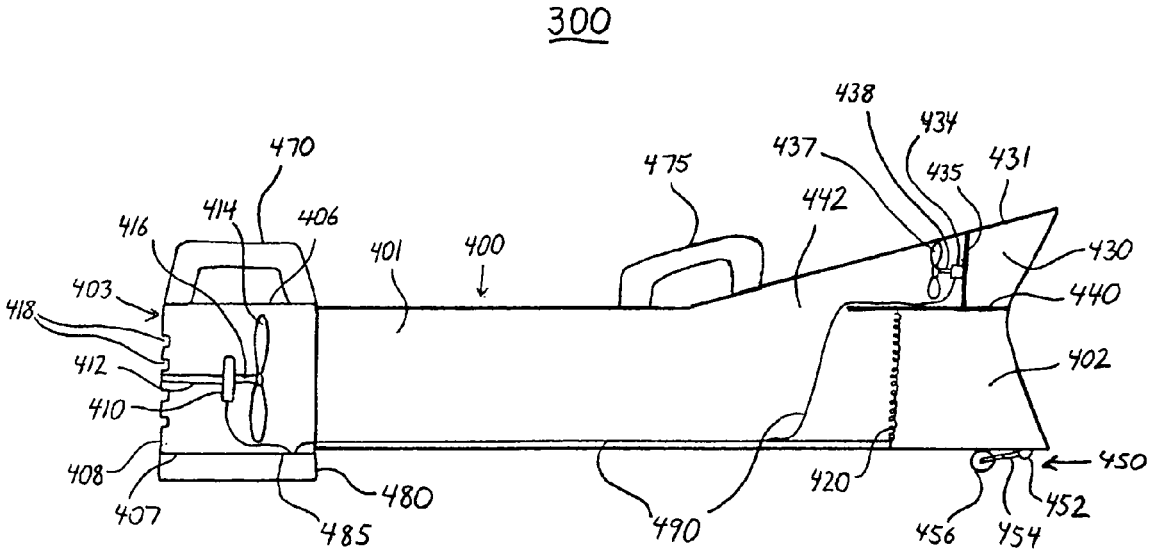
FIG. 5 shows a sectional side view of a second preferred embodiment of a system for removing snow and ice according to the present invention.

A detailed sectional side view of a second preferred embodiment of a snow and ice removal system 300 according to the present invention is shown in FIG. 5. System 300 may include a main housing unit 400 containing a duct section 401, a heat production section 402, and a heat reclamation section 430. An open front end of duct section 401 may lead into an open back end of both heat production section 402 and heat reclamation section 430. Duct section 401 and heat production section 402 may have the same general cross-sectional shape. Duct section 401 and heat production section 402 may be tubular, as shown in FIG. 6, or they may have separate and distinct walls and angles. Heat production section 402 may be separated from heat reclamation section 430 by a dividing wall 440 located at the top of heat production section 402.

Heat reclamation section 430 may be defined by a top wall 431, two side walls 432, and dividing wall 440 serving as its bottom. Heat reclamation section top wall 431 may slope upwards from the open back end of heat reclamation section 430 to an open front end of heat reclamation section 430. Heat reclamation section side walls 432 may be substantially triangular in shape. Dividing wall 440 may extend from one side wall 432 to the other side wall 432, and from the open front end of heat reclamation section 430 toward, but not reaching, the top of duct section 401. The space between dividing wall 440 and the top of duct section 401 may define an air transfer opening 442, which allows recycled heated air to pass from heat reclamation section 430 to duct section 401 and heat production section 402, as more fully discussed below. All walls of main housing unit 400 may be made of plastic or another durable material.

System 300 also may include a fan housing unit 403 defined by a top wall 406, a bottom wall 407, a rear wall 408, and two side walls 409. An open front end of fan housing unit 403 may coincide with an open back end of duct section 401. Fan housing unit 403 may have the same general cross-sectional shape as duct section 401, or their shapes may differ and only the open front end of fan housing unit 403 and the open back end of duct section 401 may have the same shape. The walls of fan housing unit 403 may be made of plastic or another durable material.

A primary motor 410 may be disposed within fan housing unit 403, and may be mounted to fan housing unit 403 by a primary motor mounting means 412. Primary motor mounting means 412 may be one or more rigid posts made of metal or another rigid material. Primary motor mounting means 412 may be mounted to rear wall 408 of fan housing unit 403, as shown in FIG. 5, or may alternatively be mounted to fan housing unit top wall 406, bottom wall 407, and/or side walls 409. A primary fan 414 may be rotatably attached to primary motor 410, disposed towards the front end of fan housing unit 403 relative to primary motor 410, by a primary fan mounting means 416. Primary fan mounting means 416 may be made of metal, plastic, or another sturdy material. A plurality of vents 418 may be defined by spaces in rear wall 408, and may wrap around to one or both side walls 409. Vents 418 may allow outside air to pass through rear wall 408 and into fan housing unit 403.

A heating element 420 may be disposed within, and mounted to the walls of, heat production section 402. Heating element 420 may consist of one or more heating coils or any other electrically powered heat source capable of fitting within heat production section 402.

A secondary motor 434 may be disposed within heat reclamation section 430, and may be mounted to heat reclamation section 430 by a secondary motor mounting means 435. Secondary motor mounting means 435 may be one or more rigid posts made of metal or another rigid material. Secondary motor mounting means 435 may be mounted to heat reclamation section top wall 431 and dividing wall 440, as shown in FIG. 5, and/or to heat reclamation section side walls 432. A secondary fan 437 may be rotatably attached to secondary motor 434, disposed towards the back end of heat reclamation section 430 relative to secondary motor 434, by a secondary fan mounting means 438. Secondary fan mounting means 438 may be made of metal, plastic, or another sturdy material.

As shown in FIG. 6, a lower screen 444 may be disposed at, and may substantially cover, an open front end of heat production section 402. An upper screen 446 may be disposed at, and may substantially cover, the open front end of heat reclamation section 430. Lower screen 444 and upper screen 446 may be made of metal, plastic, or another durable material. Lower screen 444 and upper screen 446 may allow air to pass through the front ends of heat production section 402 and heat reclamation section 430 while preventing accidental access to its interior by users.

A retractable wheel apparatus 450 may be disposed on the bottom of main housing unit 400, toward the front end of heat production section 402. Retractable wheel apparatus 450 may consist of a wheel mount 452, a wheel attachment means 454, and a wheel 456. Wheel mount 452 may be permanently mounted to main housing unit 400. Wheel attachment means 454 may be rotatably attached to wheel mount 452 so that wheel attachment means 454 may rotate from a lowered position, where wheel attachment means 454 is substantially perpendicular to the bottom of main housing unit 400, to a raised position, where wheel attachment means 454 is pointed away from the front end of heat production section 402, as shown in FIG. 5. This may be accomplished using a ball-and-socket joint disposed within wheel mount 452, or by any other means suitable to moveably attach wheel attachment means 454 to wheel mount 452. Wheel mount 452 and wheel attachment means 454 may be made of any durable material. Wheel 456 may be rotatably attached to an opposite end of wheel attachment means 454 so that wheel 456 may rotate freely with respect to wheel attachment means 454. Wheel 456 may be made of rubber or another like material. Alternatively, a wheel may be rotatably attached to a wheel attachment means which is non-moveably mounted to the bottom of main housing unit 400, toward the front end of heat production section 402.

A rear handle 470 may be disposed on the outside of fan housing unit 403, and a front handle 475 may be disposed on the outside of main housing unit 400. Rear handle 470 may be attached to fan housing unit top wall 406, as shown in FIG. 5, to rear wall 408, or one end of rear handle 470 may be attached to top wall 406, rear handle 470 may wrap around the edge between top wall 406 and rear wall 408, and a second end of rear handle 470 may be attached to rear wall 408. Alternatively, one or more rear handles 470 may be disposed on one or both fan housing unit side walls 409. Front handle 475 may be attached to main housing unit 400 at any position on an upper portion thereof, as long as a user is able to comfortably hold both rear handle 470 and front handle 475 simultaneously. Alternatively, system 300 may have only one handle located on the outside of either main housing unit 200 or fan housing unit 403.

System 300 also may include, as a power source means, a rechargeable battery 480. Battery 480 may be detachably mounted to a battery terminal 485 located on bottom wall 407 of fan housing unit 403, or at another location outside either fan housing unit 403 or main housing unit 400. A series of electrical wires 490 may be connected at one end to battery terminal 485 and at their respective other ends to primary motor 410, secondary motor 434, and heating element 420 to allow the flow of electricity to each of those respective elements. Alternatively, system 300 may utilize an external power source means such as those described above in connection with the first preferred embodiment of the present invention.

In operation, primary fan 414, powered by primary motor 410, generates high velocity wind as it blows air through duct section 401 and heat production section 402. Said air is heated to a temperature sufficient to melt snow and ice from a surface as it is blown past heating element 420. The heated air is blown through the open front end of heat production section 402 and, when system 300 is aimed at it, makes contact with snow and/or ice on a surface and acts to melt said snow and/or ice. At least some of the heated air that does not reach the snow and/or ice rises toward the open front end of heat reclamation section 430. To maximize the amount of unused heated air that reaches the open front end of heat reclamation section 430, it may be concavely curved or angled with respect to the open front end of heat production section 402, as shown in FIG. 5, or at least substantially parallel with the same. The unused heated air that reaches the open front end of heat reclamation section 430 is drawn into heat reclamation section 430 and blown through air transfer opening 442 by secondary fan 437. Along with fresh air drawn through vents 418, the unused heated air is again blown by primary fan 414 past heating element 420 and through the open front end of heat production section 402. By thus recycling unused heated air, the temperature of the air that is blown out of heat production section 402 may continue to increase, causing snow and/or ice to melt more quickly, and thereby conserving the power needed from battery 480 as well as the energy exerted by the user of system 300.

Thus, a system for removing snow and/or ice from a surface and for recapturing and reusing expelled but unused heated air is provided. Persons skilled in the art will appreciate that the described embodiments are presented for the purpose of illustration rather than limitation and the present invention is limited only by the claims that follow.

What is claimed is:

1. A system for melting snow and ice comprising:

a housing defined by a top section, a bottom section, a rear section, two side sections, and a substantially hollow cavity;

a first fan means, rotatably mounted within the substantially hollow cavity of said housing, for blowing air toward an open front end of said housing;

a heating means, mounted within the substantially hollow cavity of said housing between said fan means and the open front end of said housing, for heating air blown by said fan means;

a heat reclamation means for recapturing at least some of the heated air blown out of said housing by said fan means and directing the recaptured air back into said housing, wherein said heat reclamation means comprises a substantially hollow duct, an open front end of which is positioned substantially above the open front end of said housing, and an open back end of which leads into a hole disposed within said housing, and wherein said heat reclamation means comprises:

a second fan means, rotatably mounted within the substantially hollow duct of said heat reclamation means, for blowing air toward the hole disposed within said housing; and a power source means for powering said first and second fan means and said heating means.

2. The system according to claim 1, wherein the rear section of said housing defines a plurality of vents disposed therein.

3. The system according to claim 1, wherein said heating means comprises at least one electric heating element.

4. The system according to claim 3, further comprising at least one handle means, mounted to an outer surface of one of said housing and said heat reclamation means, for facilitating handling and maneuverability of said system.

5. The system according to claim 3, further comprising at least one wheel means, rotatably attached to an outer face of the bottom section of said housing, for facilitating movement of said system across & surface.

6. A system for melting snow and ice comprising:

a housing defined by a top section, a bottom section, a rear section, two side sections, and a substantially hollow cavity, said rear section defining a plurality of vents disposed therein;

a fan rotatably mounted within the substantially hollow cavity of said housing;

at least one heating element mounted within the substantially hollow cavity of said housing between said fan and an open front end of said housing;

a substantially hollow duct, an open front end of which is positioned substantially above the open front end of said housing, and an open back end of which leads into a hole disposed within the top section of said housing;

at least one handle mounted to an outer surface of one of said housing and said duct; and a power source means for powering said fan and at least one heating element.

7. The system according to claim 6, wherein the hole disposed within the top section of said housing is located between said fan and the rear section of said housing.

8. The system according to claim 6, wherein the hole disposed within the top section of said housing is located between said fan and at least one heating element.

9. The System according to claim 6, further comprising a second fan rotatably mounted within said hollow duct and positioned so as to blow air toward said hole disposed within the top section of said housing.

* * * * *